United States Patent [19]

Spanjer et al.

[11] Patent Number: 4,988,929

[45] Date of Patent: Jan. 29, 1991

[54] PICTURE DISPLAY DEVICE

[75] Inventors: Tjerk G. Spanjer; Gerardus A. H. M. Vrijssen; Willem M. Van Alphen, all of Eindhoven, Netherlands

[73] Assignee: U.S. Philips Corporation, New York, N.Y.

[21] Appl. No.: 462,151

[22] Filed: Jan. 8, 1990

[30] Foreign Application Priority Data

Jan. 12, 1989 [NL] Netherlands ..... 8900067

[51] Int. Cl.[5] ..... H01J 29/58

[52] U.S. Cl. ..... 315/382; 313/450

[58] Field of Search ..... 315/382; 313/450

[56] References Cited

U.S. PATENT DOCUMENTS 4,827,184 5/1989 Spanjer et al. ..... 313/450

4,857,797 8/1989 Vrijssen et al. ..... 313/450

*Primary Examiner*—Theodore M. Blum

*Attorney, Agent, or Firm*—Robert J. Kraus

[57] ABSTRACT

Picture display device comprising a display tube having an electron gun with an electrostatic focusing lens for generating a focusing lens field, which tube further comprises deflection means for generating a deflection field. The focusing lens field partly overlaps the deflection field. The focusing lens comprises a tubular structure having an inner surface on which a helical resistance structure of a material having a high electrical resistance is provided, which tubular structure has a coaxial input portion and a coaxial output portion, the output portion having dimensions which prevent the deflected electron beam from impinging upon the glass of the inner wall. Correction means may be provided for correcting errors caused by the advanced position of the focusing lens.

5 Claims, 3 Drawing Sheets

PICTURE DISPLAY DEVICE

BACKGROUND OF THE INVENTION

The invention relates to a picture display device comprising a display tube having a display screen and an electron gun facing said screen and having a cathode centred along an electron-optical axis and a plurality of electrodes which jointly constitute a beam-forming part for generating an electron beam, said gun further comprising an electrostatic focusing lens for generating a focusing lens field, said tube further comprising deflection means for generating a deflection field which overlaps at least a part of the focusing lens field.

In the current display tubes the focusing lens of the electron gun is always placed outside the deflection field. However, on theoretical grounds it is attractive to arrange the electrostatic electron lens for focusing the electron beam on the display screen at least partly within the system of deflection coils, thus obtaining a shorter device on the one hand and a reduction of the distance between the focusing lens and the display screen on the other hand. The function of the focusing lens is to image the cathode or the cross-over of the electron beam on the display screen. The magnification occurring during imaging is proportional to the distance between the focusing lens system and the display screen and proportional to the distance between the object to be imaged and the focusing lens system, though to a lesser extent. Consequently, the shorter the first-mentioned distance, the smaller the electron-optical magnification of the spot and the better the resolution of the display device.

Particularly when the spherical aberration of the focusing lens is considered and when optimum solutions are sought for imaging the cross-over or cathode, the distance between the focusing system and the screen remains of the greatest importance. The relation stating that the extent of focusing is proportional to the inverse value of this distance remains valid. The influence of the distance between cathode and focusing lens is then of much lesser importance.

In view of the above the focusing lens should be placed as far as possible towards the display screen, i.e. as far as possible forward in the deflection field. However, the further the focusing lens is located within the system of deflection coils, the more the deflection field is counteracted by eddy currents which are generated in the electrically readily conducting components (metal cylinders, etc.) of the conventional focusing lens. Apart from the shielding action with respect to the field generated by the system of deflection coils, these eddy currents also produce magnetic fields which disturb the focusing.

SUMMARY OF THE INVENTION

It is one of the objects of the invention to solve the above-mentioned problem.

According to the invention, a picture display device of the type described in the opening paragraph is therefore characterized in that the focusing lens comprises a tubular structure having an inner surface on which a helical resistance structure of a material having a high electrical resistance is provided, said tubular structure having a coaxial input portion and a coaxial output portion, the output portion having dimensions preventing the deflected electron beam from impinging upon the glass of the inner wall.

As a result of the high resistance of the helical structure of the focusing lens the occurrence of eddy currents, and hence counteracting of the deflection field, is avoided to a considerable extent.

In the picture display device according to the invention the focusing lens can therefore be moved further forward in the deflection field without any detrimental consequences than was possible in prior art picture display devices. The helical resistance structure generally has a configuration for generating, upon energization, a focusing lens field which has a portion having a converging effect on the electron beam followed by a portion having a diverging effect on the electron beam. The focusing lens can now advantageously be moved forward to such an extent that the deflection field at least partly overlaps the lens field part having the converging effect.

Since the tubular structure of the focusing lens is placed so far to the front, the output portion of this structure should have such dimensions that the deflected beam does not impinge upon the glass of the inner wall. Preferably, the tubular structure therefore flares out towards the display screen. A particularly practical solution is to provide the helical resistance track on the inner side of the envelope of the display tube.

However, another problem presents itself when moving the tubular structure further to the front. The further the focusing lens extends into the deflection field, the greater the extent to which the electron beam in the lens is deflected from the central position. As a result, not only spherical aberrations but also other aberrations are produced which partly annihilate the reduction of the spot enlargement which results from reducing the distance between the focusing lens and the display screen. These aberrations result from the fact that the beam no longer traverses the focusing lens field centrally because the deflection field passes through the focusing lens field. The most disturbing aberration among these electron-optical aberrations is spot growth due to coma, while spot growth due to deflection astigmatism and curvature of field also appear to occur. Curvature of field means that the main surface of the image, also referred to as "surface of best focus" does not coincide with the display screen.

If maximum benefit is to be gained from an overlap of the deflection field with the focusing lens field, at least the spot growth due to coma should be inhibited. This may be ensured as follows within the scope of the invention.

For compensating spot growth due to coma a first embodiment of a picture display device according to the invention is characterized in that the display tube comprises an auxiliary device arranged between the beam-shaping gun part and the focusing lens for generating a dipole field which pre-deflects the electron beam synchronously with and in a direction opposite to the direction in which the beam is deflected by the system of deflection coils (so that at an average the beam passes through the centre of the lens).

For compensating spot growth due to deflection astigmatism a second embodiment of the picture display device according to the invention is characterized in that the electron gun is provided with a dynamically controllable electrostatic or magnetic 2N-pole element (N is 2 or 4) arranged between the beam-shaping gun part and the focusing lens.

For compensating spot growth due to curvature of field a third embodiment of a picture display device according to the invention is characterized in that the helical resistance structure is provided with connection means, while voltage-supplying means are provided for applying a dynamic voltage to the connection means for varying the power of the focusing lens as a function of the position of the electron beam spot on the display screen (so-called dynamic focus).

The above-described measures may be used separately or jointly.

BRIEF DESCRIPTION OF THE DRAWING

Some embodiments of the display tubes for displaying devices according to the invention will now be described in greater detail with reference to the accompanying drawing in which.

DESCRIPTION OF THE PREFERRED EMBODIMENTS

Figure 1:
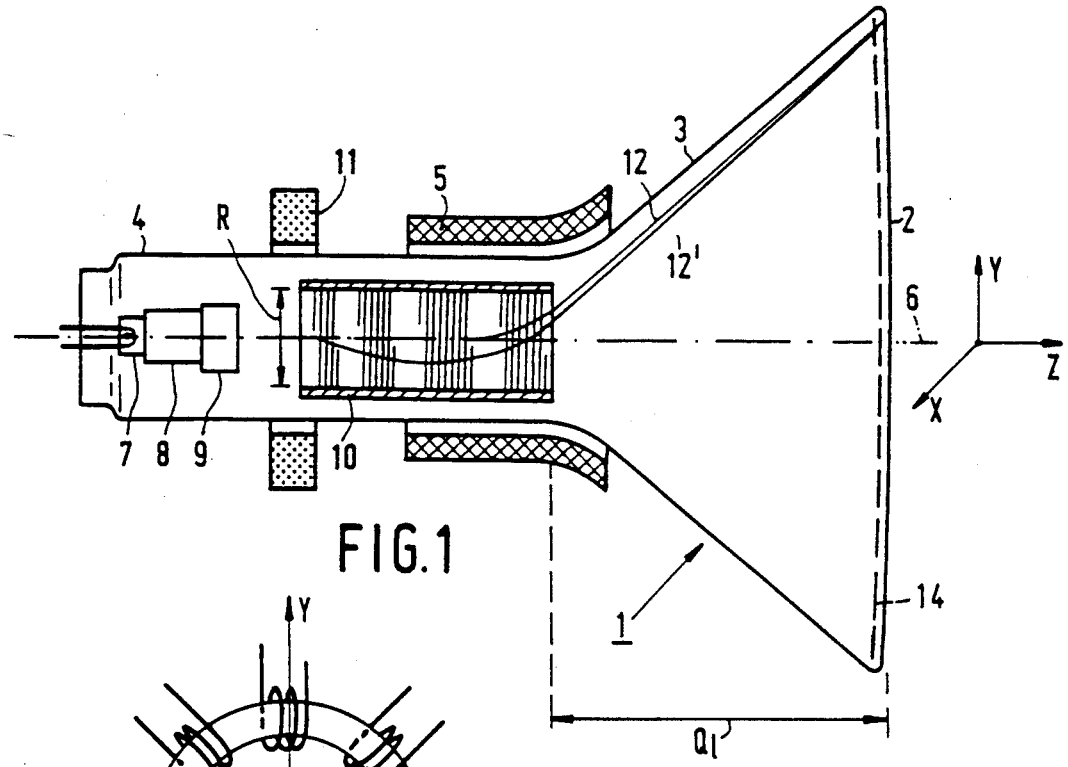
FIG. 1 is a diagrammatic cross-section of a display tube for a picture display device according to the invention.

The device shown in FIG. 1 comprises a cathode ray tube having, inter alia, a glass envelope 1 which is composed of a display window 2, a conical portion 3 and a neck 4. This neck accommodates a plurality of electrode structures 8, 9, 10, which together with a cathode 7 constitute an electron gun. The electron-optical axis 6 of the electron gun is also the axis of the envelope. An electron beam 12 is successively formed and accelerated by the cathode 7 and the electrode structures 8, 9. The electrode structure 10 constitutes a focusing lens which focuses the beam on a display screen 14 on the inner side of the display window 2. The electrode structure 10 is constituted by a helical resistance track of a material having a high electrical resistance which is provided on the inner surface of a tubular structure. Conventionally applied voltages are, for example

| | |
|---|---|
| cathode 7 | 50 V |
| electrode 8 | 0 V |
| electrode 9 | 500 V |
| entrance side of electrode 10 | 7 kV |
| exit side of electrode 10 | 30 kV |

Generally, the potential at the exit side of the focusing lens electrode is a factor of 2 to 10 higher than the potential at the entrance side of the focusing lens electrode. The electron beam 12 is deflected from the axis 6 across the display screen 14 by means of a system 5 of deflection coils. Display screen 14 comprises a phosphor layer which is coated with a thin aluminum film which may be electrically connected to electrode 10 via a conducting coating on the inner wall of the conical portion 3.

Figure 3:
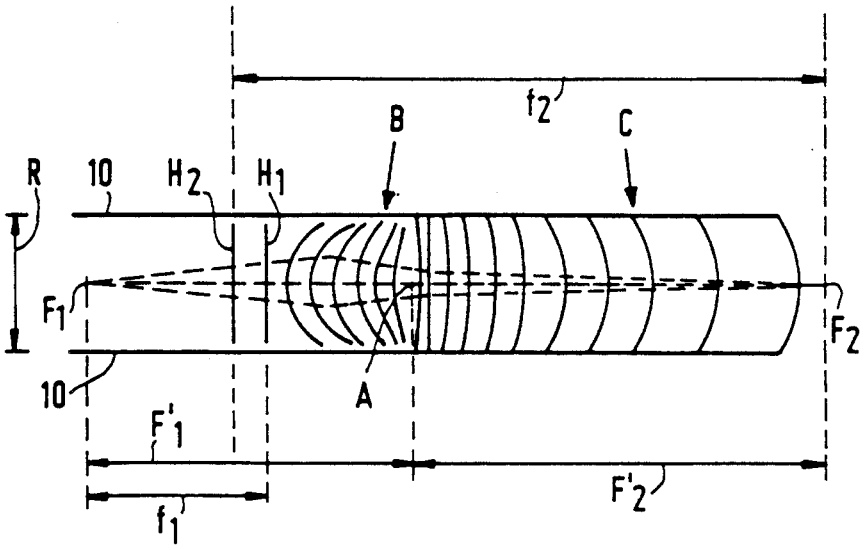
FIG. 3 shows a focusing field which can be generated by means of an electron gun of the type shown in FIG. 2.

FIG. 3 diagrammatically shows an example of a focusing lens field which can be generated by the focusing lens 10. The curved lines represent the lines of intersection of the equipotential planes which are produced by applying a voltage difference across the ends of the helical resistance track, in the plane of the drawing. Each equipotential plane represents a plane having an equal refractive index. The centre of the lens is the point A. The focal lengths $f_1$ and $f_2$ are the distances between the focus $F_1$ and the first main surface $H_1$ and the distance between the focus $F_2$ and the second main surface $H_2$, respectively. The foci $F_1$ and $F_2$ are located at distances $F'_1$ and $F'_2$ respectively, from the centre A. The focusing lens field has in this case a portion B with a converging effect and a portion C with a diverging effect on the beam. The focusing lens constituted by the electrode structure 10 (FIG. 1) is partly located within the deflection coil system 5. Since the focusing lens is less far remote from the display screen than in tubes in which the focusing lens is located in front of the deflection coils, the angular aperture of the beam on the display screen is larger if the electron beam diameter in the focusing lens remains the same, thus with equal aberrations and a given cathode load, so that a smaller electron spot is realised on the display screen. This results in a better resolving power. The focusing lens may advantageously be moved so far into the system of deflection coils that the deflection field at least partly overlaps the lens field portion having a converging effect on the electron beam. Depending on the manner of voltage supply, the focusing lens can be e.g. of the unipotential, the bi-potential, or of the tri-potential type.

Since the focusing lens is partly located in the field of the deflection coils, it is implemented within the scope of the invention as a helical structure of a material having a high electrical resistance and is provided on the inner wall of a tubular structure so as to suppress the occurrence of eddy currents in the material of the lens electrode to a maximum possible extent.

The invention may be used to advantage in all picture display devices comprising cathode ray tubes and particularly in projection television display devices.

Figure 2:
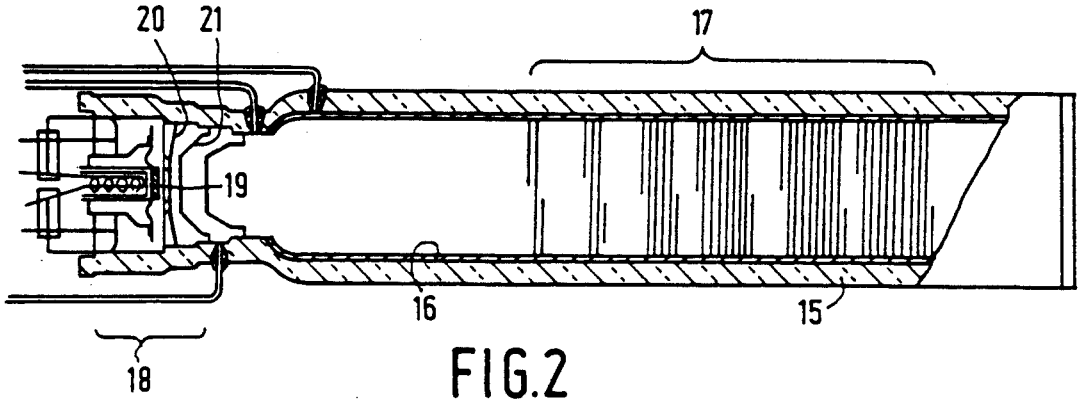
FIG. 2 is an elevational view of a longitudinal section of an electron gun suitable for use in the display tube of FIG. 1.

FIG. 2 shows an electron gun of a type suitable for use in the display tube of FIG. 1. The type in question comprises a tubular (glass) envelope 15. A high-ohmic resistance layer 16 is provided on the inner side of the envelope 15, in which layer a helical structure is formed near one end, constituting a focusing lens field 17. The high-ohmic resistance layer 16 may be, for example glass enamel with a small amount (for example, several % by weight) of metal oxide (particularly ruthenium oxide) particles. The layer 16 may have a thickness of between 1 and 10 $\mu$m, for example 3 $\mu$m. The resistance per square of such a layer depends on the concentration of metal oxide and the firing treatment to which the layer is subjected. Resistances per square varying between 10.4 and 10.8 $\Omega$ have been realised in practice. A desired resistance per square can be realised by adjusting the relevant parameters. A resistance per square of the order of $10^6$ to $10^7$ $\Omega$ is very suitable for the present application. The total resistance of the helical structure formed in the layer 16 (which structure may be a continuous helix or a plurality of separate helixes connected by segments without a helical structure—6 in the embodiment of FIG. 2—) may be of the order of 10 G$\Omega$, which means that a current of several micro-amperes will flow across the ends at a voltage difference of 30 kV.

Figure 4:
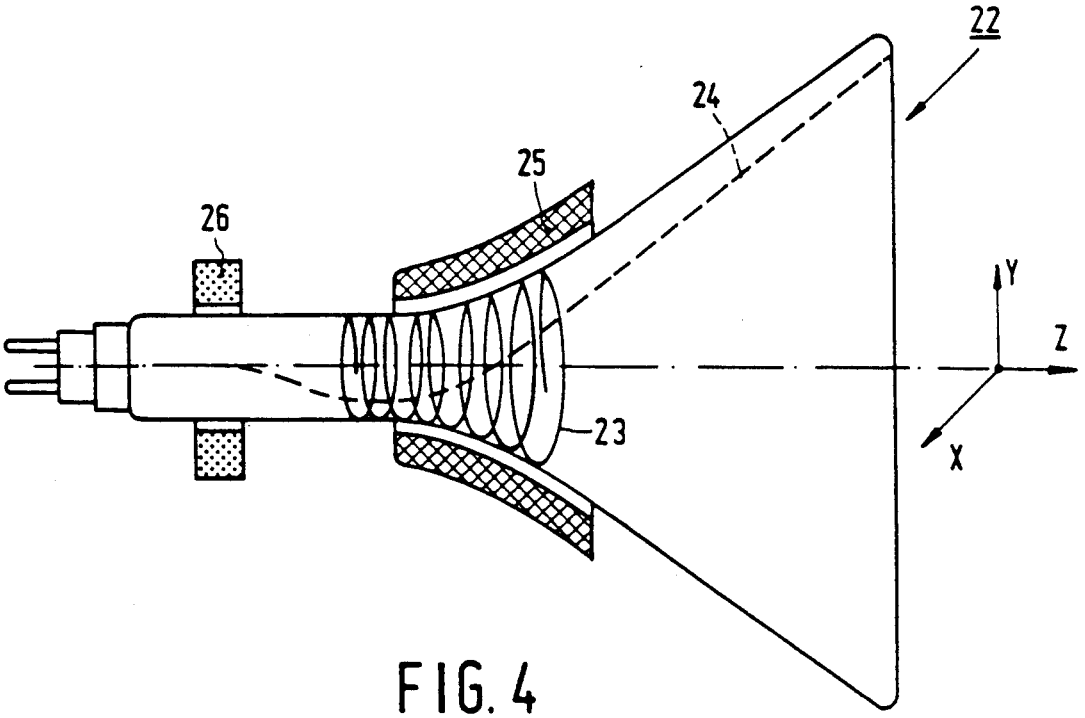
FIG. 4 shows an alternative embodiment of a display tube in a cross-section.

The electron gun of FIG. 2 comprises a beam-forming part 18 in front of the focusing lens 17, which part generally comprises a cathode 19, a grid electrode 20 and an anode 21. The components of the beam-shaping part 18 may be mounted in the tubular envelope 15 of the focusing lens 1, as in the gun shown in FIG. 2. Alternatively, they may be mounted outside the tubular envelope of the focusing lens in the display tube, for example, by securing them to axial glass-ceramic mounting rods. The tubular envelope 15 may advantageously be constituted by the neck of the display tube. Such a display tube 22 is shown diagrammatically in FIG. 4. The particular advantage of such a construction is that the electron beam 24 deflected by the deflection coil system 25 is prevented from impinging upon the helical structure because the high-ohmic resistance layer with the helical structure 23 of the focusing lens is provided on a part of the envelope of the display tube 22 where it is flared. In the construction of the display tube shown in FIG. 1 this may be a problem which may be inhibited by giving, for example, the tubular envelope of the focusing lens 10 a flared end. A measure which may also be advantageous is to pre-deflect the electron beam before it enters the focusing lens in a direction opposite to the main direction of deflection. An electron beam which is thus pre-deflected is denoted by 12' in FIG. 1. An electron beam which is not pre-deflected is denoted by 12. As already described hereinbefore, the fact that the electron beam is pre-deflected in an opposite direction is a useful correction means of reducing spot growth due to coma in the display tube according to the invention. To realise a pre-deflection, the display tube may have a system of coils (denoted by reference numeral 11 in FIG. 1 and reference numeral 26 in FIG. 4).

Figure 1A:
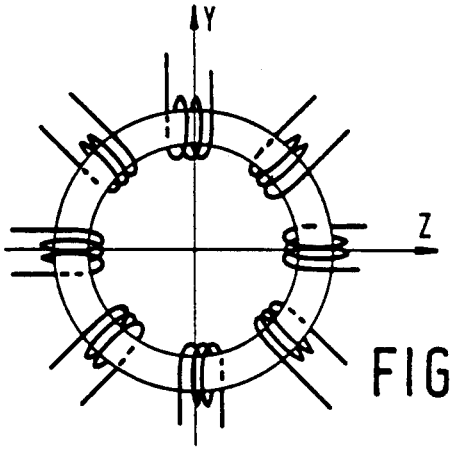
FIG. 1*a* shows a system of coils.

Such a coil system 11 or 26 may have an annular magnetic core 27 on which, for example, one or two sets of four coils are wound (FIG. 1*a*). By dynamically energising these coils selectively, electromagnetic pre-deflection dipole fields can be generated in the x and y directions and an electromagnetic quadripole field can be generated. As described hereinbefore, spot growth due to astigmatism can be reduced in the display tube according to the invention by passing the electron beam through a quadripole field.

However, analog effects may be achieved by applying electric dipole and quadripole fields. To this end eight axial electrodes ("fingers") which can be separately controlled may be formed, for example, in the cylindrical segment, which is not provided with a helix, of the high-ohmic resistance layer 16 of the electron gun of FIG. 2.

Figure 5:
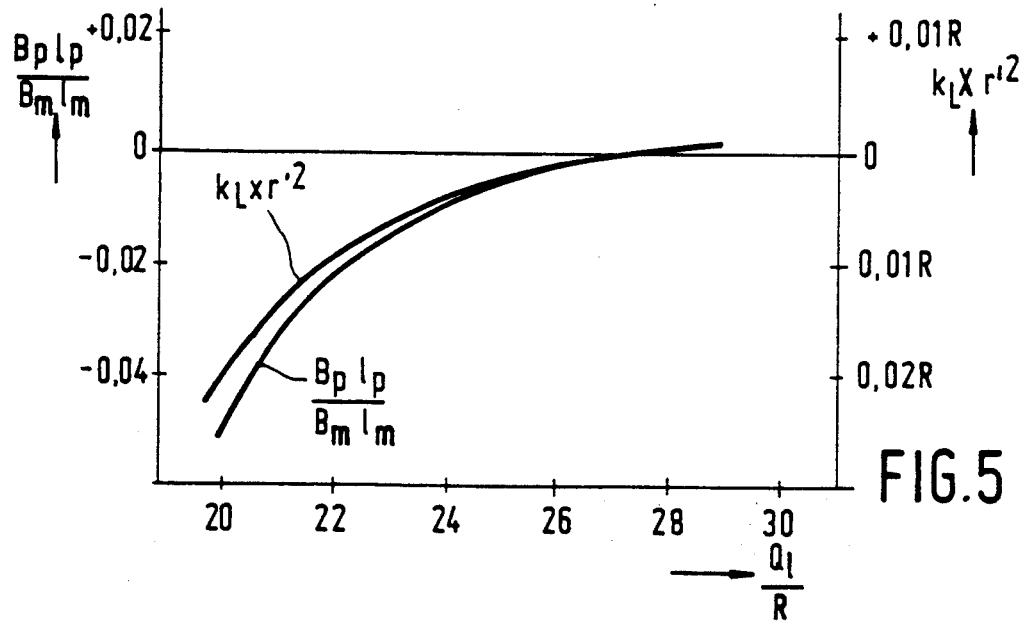
FIGS. 5, 6 and 7 show the increase of the spot dimensions as a function of moving a focusing lens towards the display screen.
Figure 6:
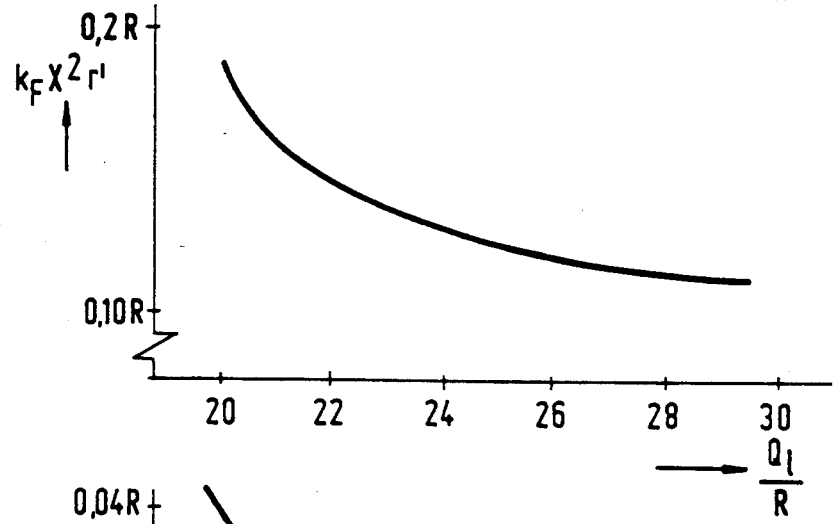
Figure 7:
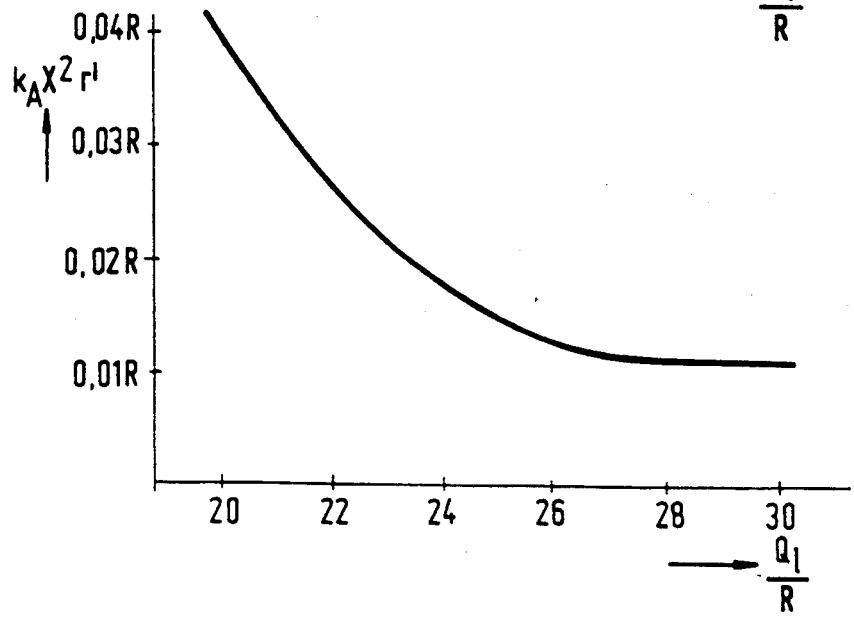

FIGS. 5, 6 and 7 show how the dimensions of the spot increase due to coma (FIG. 5), curvature of field (FIG. 6) and astigmatism (FIG. 7) when moving the focusing lens towards the display screen. The spot dimensions are determined for a beam having an angular aperture at the object side of the focusing lens of $r'=50$ mrad; object size of 50 μm and deflection on the display screen $X=7.36\times R_{lens}$. $Q_1$ is the distance between the front side of the focusing lens and the display screen (in the initial position $Q_1$ was 15 cm, in its final position $Q_1$ was 10 cm) and R is the radius of the focusing lens (in the case of the example $R=5$ mm).

In FIG. 5 the spot growth due to coma is illustrated by means of the factor $(k_{L1}Xr'^2)$ in which $k_L$ is an error coefficient and X and r' are values as defined hereinbefore.

Analogously, the spot growth due to curvature of field is illustrated in FIG. 6 by means of the factor $(k_F X^2 r')$ and the spot growth due to astigmatism is illustrated in FIG. 7 by means of the factor $(k_A X^2 r')$ in which $k_F$ and $k_A$ represent the error coefficients for these cases.

FIG. 5 also shows by means of the factor $$\frac{B_p l_p}{B_m l_m}$$

how much the required pre-deflection (=the required number of ampere turns) should be relative to the main deflection in order to render the coma zero each time. In this case B is the magnetic flux and l is the effective field length. For reducing 3rd order coma errors, a linear relationship between the power of the main field and the pre-deflection field is sufficient, which can be technically realised in a simple manner and yields good results in practice. A non-linear relationship may be desirable for reducing higher order errors.

Particularly by realising pre-deflection in front of the focusing lens, the beam will pas at an average through the centre of the focusing lens and the problem of the beam impinging upon the edge of the output portion of the tubular structure is enlarged, as it were.

It is possible within the scope of the invention to correct the curvature of field, if desired, by means of dynamic focusing. The power of the electron lens for focusing the electron beam, which lens is also referred to as focusing lens, is adjusted as a function of the deflection to which the electron beam is subjected at that moment. This makes it possible to have the then prevailing main surface of the image intersect the display screen at that area where the electron beam impinges upon the display screen. This correction method necessitates an extra circuit in the control device for generating the correct dynamic focusing voltages on the electrodes of the focusing lens.

Since the material of the helical resistance track has such a high electrical resistance (for example, 10 GΩ), the RC time is large (for example, 10 msec.). As a result, the effect of the dynamic focusing voltage does not penetrate far into the helical resistance structure. One might think that applying a dynamic focusing voltage therefore has no substantial result. However, this does not appear to be true in those cases where the line frequencies are not too high. As it were, a correction lens is obtained at the entrance side of the focusing lens, which is already sufficient. The length of the correction lens does not play a role because only the 1st order properties are important.

We claim:

1. A picture display device comprising a display tube having a display screen and an electron gun facing said screen and having a cathode centered along an electron-optical axis and a plurality of electrodes which jointly constitute a beam-forming part for generating an electron beam, said gun further comprising an electrostatic focusing lens for generating a focusing lens field, said tube further comprising deflection means for generating a deflection field which overlaps at least a part of the focusing lens field, characterized in that the focusing lens comprises a tubular structure having an inner surface on which a helical resistance structure of a material having a high electrical resistance is provided, said tubular structure having a coaxial input portion and a coaxial output portion, the output portion extending into the deflection field to the extent that said field effects deflection of the electron beam within the tubular structure, said output portion being dimensioned to prevent the deflected electron beam from impinging upon the glass of the inner surface.

2. A device as claimed in claim 1, characterized in that the tubular structure flares out towards the display screen.

3. A device as claimed in claim 1, characterized in that the display tube comprises an auxiliary device arranged between the beam-forming part and the focusing lens for generating a dipole field which pre-deflects the electron beam synchronously with and in a direction opposite to the direction in which the beam is deflected by the deflection means.

4. A device as claimed in claim 1, characterized in that the electron gun is provided with a dynamically controllable electrostatic or magnetic 2N-pole element (N is 2 or 4) arranged between the beam-forming part and the focusing lens.

5. A device as claimed in claim 1, characterized in that the helical resistance structure is provided with connection means, while voltage-supplying means are provided for applying a dynamic voltage to the connection means for varying the power of the focusing lens as a function of the position of the electron beam spot on the display screen.

* * * * *